US006743085B2

(12) United States Patent
Fritz et al.

(10) Patent No.: US 6,743,085 B2
(45) Date of Patent: Jun. 1, 2004

(54) ROTATING BACK UP ABRASIVE DISC ASSEMBLY

(75) Inventors: Peter J. Fritz, Minneapolis, MN (US); Robert G. Saunier, North Saint Paul, MN (US); Aleck Block, Los Angeles, CA (US)

(73) Assignee: 3M Innovative Properties Company, Saint Paul, MN (US)

( * ) Notice: Subject to any disclaimer, the term of this patent is extended or adjusted under 35 U.S.C. 154(b) by 81 days.

(21) Appl. No.: 09/991,513

(22) Filed: Nov. 20, 2001

(65) Prior Publication Data

US 2003/0096566 A1 May 22, 2003

(51) Int. Cl.[7] ..... B24B 21/02

(52) U.S. Cl. ..... 451/308; 451/342; 451/463; 451/464

(58) Field of Search ..... 451/342, 308, 451/463, 464, 465

(56) References Cited

U.S. PATENT DOCUMENTS

| | | | | |
|---|---|---|---|---|
| 1,869,564 A | | 8/1932 | Johnson | |
| 2,156,002 A | | 4/1939 | Tinnerman | 189/36 |
| 2,331,861 A | | 10/1943 | Smith | 51/197 |
| 2,781,618 A | | 2/1957 | Larson | 51/197 |
| 3,561,938 A | | 2/1971 | Block et al. | 51/358 |
| 3,574,978 A | | 4/1971 | Block | 51/377 |
| 3,616,581 A | | 11/1971 | Johnson et al. | 51/337 |
| 3,667,169 A | * | 6/1972 | MacKay, Jr. | 451/511 |
| 3,883,998 A | | 5/1975 | Dosser | 51/376 |
| 4,015,371 A | | 4/1977 | Grayston | 51/168 |
| 4,245,438 A | | 1/1981 | van Buren, Jr. | 51/377 |
| 4,263,755 A | | 4/1981 | Globus | 51/358 |
| 4,439,907 A | | 4/1984 | Block et al. | 29/432.1 |
| 4,439,953 A | | 4/1984 | Block et al. | 51/358 |
| 4,637,170 A | | 1/1987 | Block | 51/168 |
| 4,655,006 A | | 4/1987 | Block | 51/168 |
| 4,679,360 A | | 7/1987 | Eisenblatter | 51/337 |
| 4,683,683 A | | 8/1987 | Block | 51/358 |
| 4,718,204 A | | 1/1988 | Eisenblatter | 51/337 |
| 4,754,577 A | | 7/1988 | MacKay, Jr. | 51/168 |
| 4,760,670 A | | 8/1988 | MacKay, Jr. | 51/168 |
| 4,896,463 A | | 1/1990 | MacKay, Jr. | 51/168 |
| 5,201,149 A | | 4/1993 | Eisenblatter | 51/394 |
| 5,207,028 A | | 5/1993 | Timmons | 51/168 |
| 5,316,812 A | | 5/1994 | Stout et al. | 428/64 |
| 5,339,571 A | | 8/1994 | Timmons et al. | 51/168 |

(List continued on next page.)

FOREIGN PATENT DOCUMENTS

| | | |
|---|---|---|
| EP | 0 444 824 A2 | 9/1991 |
| EP | 0 530 983 A | 3/1993 |
| GB | 1 221 145 | 2/1971 |
| WO | WO 95/03370 | 2/1995 |
| WO | WO 01/08849 A1 | 2/2001 |

OTHER PUBLICATIONS

U.S. patent application Ser. No. 09/865,947, Fritz et al., filed May 25, 2001.

*Primary Examiner*—Joseph J. Hail, III
*Assistant Examiner*—Alvin J Grant

(57) ABSTRACT

A holder for an abrasive disc allows for a quick manual change of the abrasive disc. The holder including an uncoupling mechanism that in turn includes a handle comprising a pin and an adjacent hub comprising a partial annular channel. The handle and hub have a limited rotational engagement wherein the pin travels in the channel. When an operator desires to replace an abrasive disc, the operator grasps the handle with one hand and rotates the disc, face plate, and hub, together as a unit, with the other hand. This counter-rotation breaks the tight attachment of the disc on the shaft of the finishing tool, so that disc can be easily unthreaded from the shaft.

20 Claims, 4 Drawing Sheets

U.S. PATENT DOCUMENTS

| | | | | | |
|---|---|---|---|---|---|
| 5,490,720 | A | | 2/1996 | Archibald | 301/35.62 |
| 5,538,464 | A | * | 7/1996 | MacKay, Jr. | 451/342 |
| 5,573,619 | A | | 11/1996 | Benedict et al. | 156/137 |
| 5,669,941 | A | | 9/1997 | Peterson | 51/295 |
| 5,707,275 | A | | 1/1998 | Preis et al. | 451/342 |
| 5,722,881 | A | | 3/1998 | Emerson | 451/464 |
| D394,530 | S | | 5/1998 | Roeker | D32/15 |
| 5,752,876 | A | | 5/1998 | Hettes | 451/463 |
| 5,756,409 | A | | 5/1998 | van Dijen et al. | 50/189 |
| 5,871,322 | A | | 2/1999 | Nakamura | 411/432 |
| 5,871,399 | A | | 2/1999 | Emerson | 451/465 |
| 5,947,804 | A | * | 9/1999 | Fukinuki et al. | 451/357 |
| 5,951,389 | A | | 9/1999 | Hettes et al. | 451/508 |
| 6,095,910 | A | | 8/2000 | Luedeke | 451/359 |

* cited by examiner

ROTATING BACK UP ABRASIVE DISC ASSEMBLY

FIELD OF THE INVENTION

The present invention relates to a holder assembly for an abrasive (including polishing) disc. More specifically the invention relates to a holder which allows for a quick manual change of the abrasive disc.

RELATED ART

Abrasive articles generally contain an abrasive material, typically in the form of abrasive grains, abrasive brushes or nonwoven abrasive filaments bonded to a backing plate. Such articles usually take the form of sheets, discs, belts, bands, and the like, which can be adapted to be mounted on power tools. A variety of abrasive articles are used to abrade or polish various substrates, including steel and other metals, wood, wood-like laminates, plastic, fiberglass, leather, and ceramics. The abrasive articles can be in any of a variety of forms, including coated abrasives, bounded abrasives, abrasive brushes, and nonwoven abrasives. Such articles ususally take the form of sheets, discs, belts, bands, and the like, which may be adapted, for example, to be mounted on pulleys, wheels, or drums.

Many abrasive articles are used as discs in grinding assemblies. A typical such abrasive sanding or grinding assembly includes: an annular back-up pad made from a resilient and reinforced material such as rubber or plastic and an abrasive disc having a backing plate and an abrasive material (e.g., coated abrasive discs and nonwoven abrasive discs that include abrasive materials such as abrasive grains). The abrasive material may completely or partially cover the surface of the backing plate. For example, one type of abrasive disc uses a thick annular ring of abrasive material applied to the backing plate such that the inner radial boundary of the abrasive is concentric with the backing plate. Examples of abrasive discs having an annulus of abrasive material include flap discs, non-woven surface conditioning discs, and grinding wheels. The backing plate used in the abrasive discs are typically made of paper, certain polymeric materials (e.g., phenolic impregnated fiberglass), cloth, nonwoven materials, vulcanized fiber, and combinations of these materials. During the grinding process, the disc may be subjected to relatively severe stresses.

Abrasive discs have a finite useful life when applied against a workpiece. The discs are disposable so that they can be replaced after use. It is highly desirable for the discs to be easily and quickly removed and replaced.

In the past, many methods have been used to secure the abrasive disc to the tool. For example, it is known to mechanically mount a hub on the back side of the disc, the hub being attachable to the end of a tool shaft. If the torque load is substantial, the disc tends to rupture at the periphery of the hub or to separate from the hub. In addition to such disadvantages, a suitable hub and its permanent mounting on the disc involves a significant cost factor, as it must be discarded with the used disc.

An improvement includes attaching an abrasive disc to a tool by way of a holder assembly. Holders commonly include a back up pad or plate that supports the abrasive disc during use, thereby allowing an operator to exert frictional pressure on a workpiece. When the holder is rotated, the disc rotates with it, permitting the moving disc surface to effectively finish the surface of workpieces such as furniture and automobile body parts.

A variety of holder structures have been used heretofore to secure the abrasive disc to the power tool. One of the most common types includes a support pad having a reinforced central aperture arranged to be engaged over the threaded end of the rotary shaft of the power tool. The abrasive disc is placed on the flat surface of the pad and a flanged nut is turned down onto the shaft end protruding through both the holder and the disc. When the nut is tightened, it lays flush against the abrasive surface of the disc and clamps the disc to the support pad. In use, the shaft of the assembly is rotated and the abrasive surface of the disc is pressed against a workpiece with considerable force, abrading the workpiece.

During use of the abrasive disc, torque forces cause the nut member to lock onto the shaft with greater and greater holding force. Therefore, with conventional devices, the abrasive disc member can become locked so tightly onto the holder that it is difficult to remove and replace the abrasive disc. In many heavy industrial applications, the discs must be replaced quite often (e.g., over five times per hour). Consequently, considering the number of tools in use on a given shift, such disc replacement necessitates an excessive amount of downtime.

Several attempts have been made to address the problem of tightly locked discs on holders (see, e.g., U.S. Pat. No. 3,765,130 (Block), U.S. Pat. No. 4,439,953 (Block et al.), U.S. Pat. No. 4,637,170 (Block), U.S. Pat. No. 4,655,006 (Block), and U.S. Pat. No. 4,683,683 (Block)). Disadvantages of such solutions typically include one or more of the following; for example, in some of these designs, because the abrasive disc and back up assembly are very close in both size and position, it is very difficult to grasp just the abrasive disc and turn it relative to the back up assembly for removal. In others, a disc or disc fastener must be especially designed for use with the particular back up assembly, rather than of a universal design to fit the threaded rotating shaft of a tool.

BRIEF SUMMARY OF THE INVENTION

In one aspect, the present invention provides a holder for supporting an abrasive disc on a tool shaft. The holder comprises an annular internally threaded central insert threadably engaging the shaft; a handle concentrically surrounding and in fixed rotational engagement with the central insert; a hub concentrically surrounding the central insert, abutting the handle, and rotationally engaged to the handle; a pin disposed on a first face; a discontinuous channel disposed on a second face, the channel opposing the pin, so that the pin engages the channel and travels within the channel as the handle and hub are rotated with respect to each other; and a faceplate concentrically surrounding the central insert, abutting the hub, and removably engaged to the hub. In a preferred embodiment, the first face is disposed on the handle, and the second face is disposed on the hub.

The invention can be used with most standard abrasive discs which are designed to thread directly onto a tool shaft. Its design allows a user to easily grasp the handle and counterrotate it with respect to the hub, faceplate, and abrasive disc, to loosen the abrasive disc from the tool shaft.

BRIEF DESCRIPTION OF THE DRAWINGS

The present invention will be further explained with reference to the attached figures, wherein like structure is referred to by like numerals throughout the several views.

While the above-identified drawing figures set forth one preferred embodiment of the invention, other embodiments are also contemplated, as noted in the discussion. In all cases, this disclosure presents the invention by way of representation and not limitation. It should be understood that numerous other modifications and embodiments can be devised by those skilled in the art which fall within the scope and spirit of the principles of this invention.

DETAILED DESCRIPTION

Figure 1:
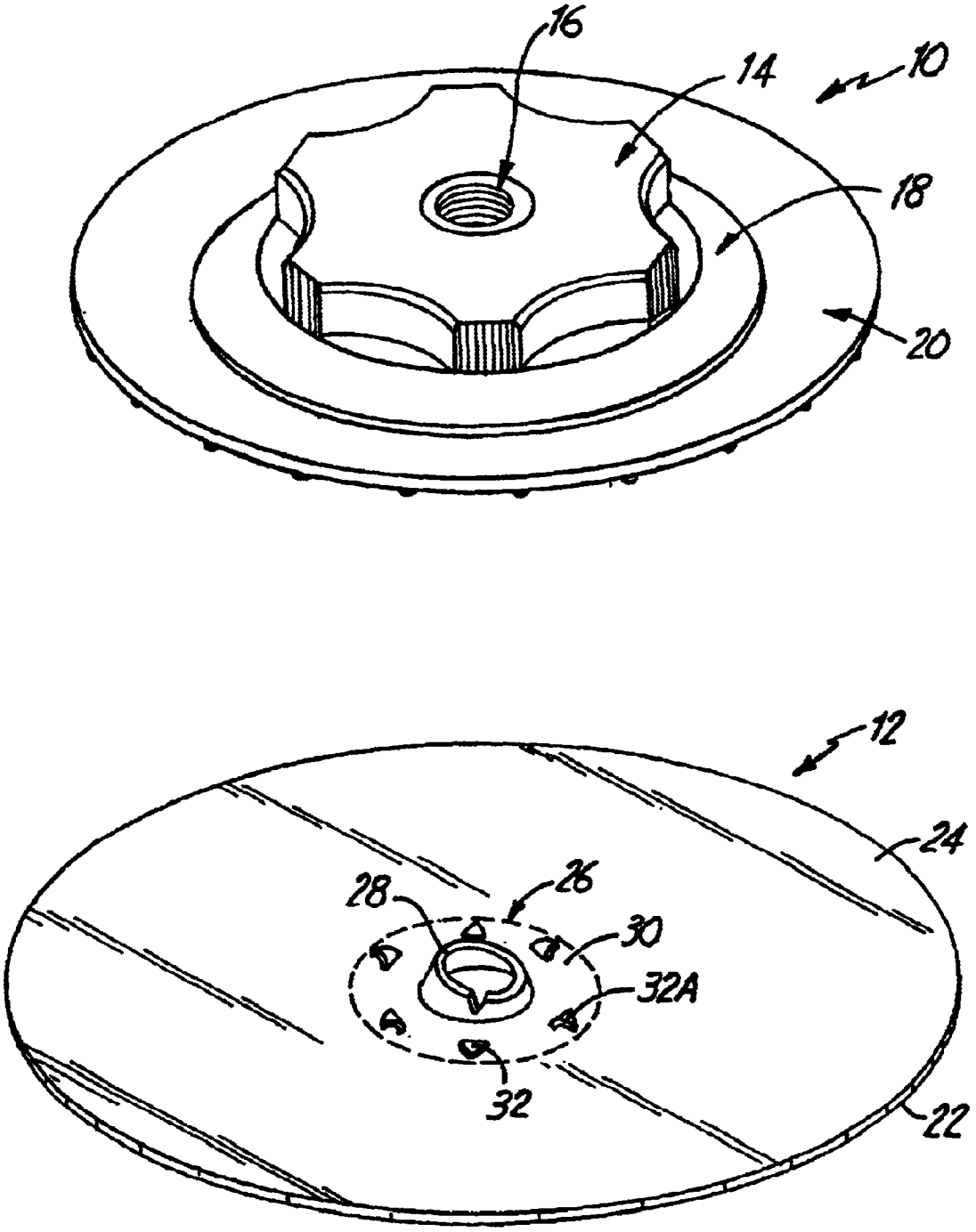
FIG. 1 is a perspective view of an exemplary abrasive disc holder according to the present invention and an abrasive disc.

FIG. 1 is a perspective view of an exemplary holder according to the present invention 10, and abrasive disc 12 to be used with holder 10. Holder 10 meets the need for an easy-to-use decoupling mechanism to allow for the quick removal of abrasive disc 12 from a tool shaft. Advantageously, holder 10 can be used with standard discs 12 that are designed to thread directly onto a rotating tool shaft.

Holder 10 includes handle 14, central insert 16, hub 18, and interchangeable face plate 20. Abrasive disc 12 comprises coating of abrasive material 22, plate of backing material 24, and fastener 26.

In holder 10, face plate 20 is removably attached to hub 18. An operator may be provided with several alternative face plates 20 of differing sizes, stiffnesses, hardnesses, or other variable characteristics. Handle 14, central insert 16, and hub 18 comprise a subassembly that may be permanently mounted to a finishing tool such as a pneumatic or electric right angle grinder (not shown). Hub 18 is rotationally engaged with handle 14, as will be discussed further with respect to FIG. 2. Central insert 16 fits through handle 14, hub 18, and face plate 20, thereby holding together the components of holder 10.

Abrasive disc 12 includes fastener 26, which can be, for example, a sheet metal nut as is known in the art, as well as, for example, a Tinnerman nut fastening device, such as described in U.S. Pat. No. 2,156,002 (Tinnerman), the disclosure of which is incorporated herein by reference. It is within the scope of the present invention to use other types of threaded fasteners without departing from the spirit and scope of the invention. A preferred nut 26 is a 1.5 inch (38.1 mm) quick-change button for mating with ⅝–11 threads, manufactured, for example, by Metal Products Engineering, Los Angeles, Calif. This nut 26 is preferred because the single-thread design allows for an inexpensive component which offers quick alignment, engagement, and disengagement. Such a nut can be formed, for example, from brass, aluminum, or steel although other materials may be used, and may be formed integrally with backing plate 24 and abrasive coating 22. A preferred abrasive disc is described in a copending patent application having U.S. Ser. No. 09/865,947, filed May 25, 2001, the disclosure of which is incorporated herein by reference.

In one embodiment, central nut 26 includes a single turn 28 supported above flat, annular flange 30. Nut 26 is attached to the underside of abrasive disc 12 using tines 32, which are disposed coaxially about flange 30. Tines 32 pass through abrasive disc 12 and have tips 32A (see FIG. 4) which are bent upward onto the back face of the plate of backing material 24. In operation, holder 10 is threaded onto a rotational shaft of a tool such as an angle grinder or drill via central insert 16. Abrasive disc 12 is then threaded, by central nut 26, onto the end of the tool shaft, so that the plate of backing material 24 presses against face plate 20.

An exemplary abrasive disc 12 includes backing plate 24 of, for example, a polyamide material or a glass-filled nylon. Abrasive coating 22 is adhered to backing plate 24. During use, the abrasive qualities of abrasive coating material 22 wear down, necessitating replacement of abrasive disc 12. When an operator desires to remove abrasive disc 12, the operator grasps handle 14 with one hand and rotates abrasive disc 12, hub 18, and face plate 20, together as a unit, with the other hand, such that abrasive disc 12, hub 18, and face plate 20 move in a direction opposite of the rotation of the tool during use. This counter-rotation breaks the tight attachment of central nut 26 to the shaft of the finishing tool, so that abrasive disc 12 can be easily unthreaded from the shaft.

Figure 2:
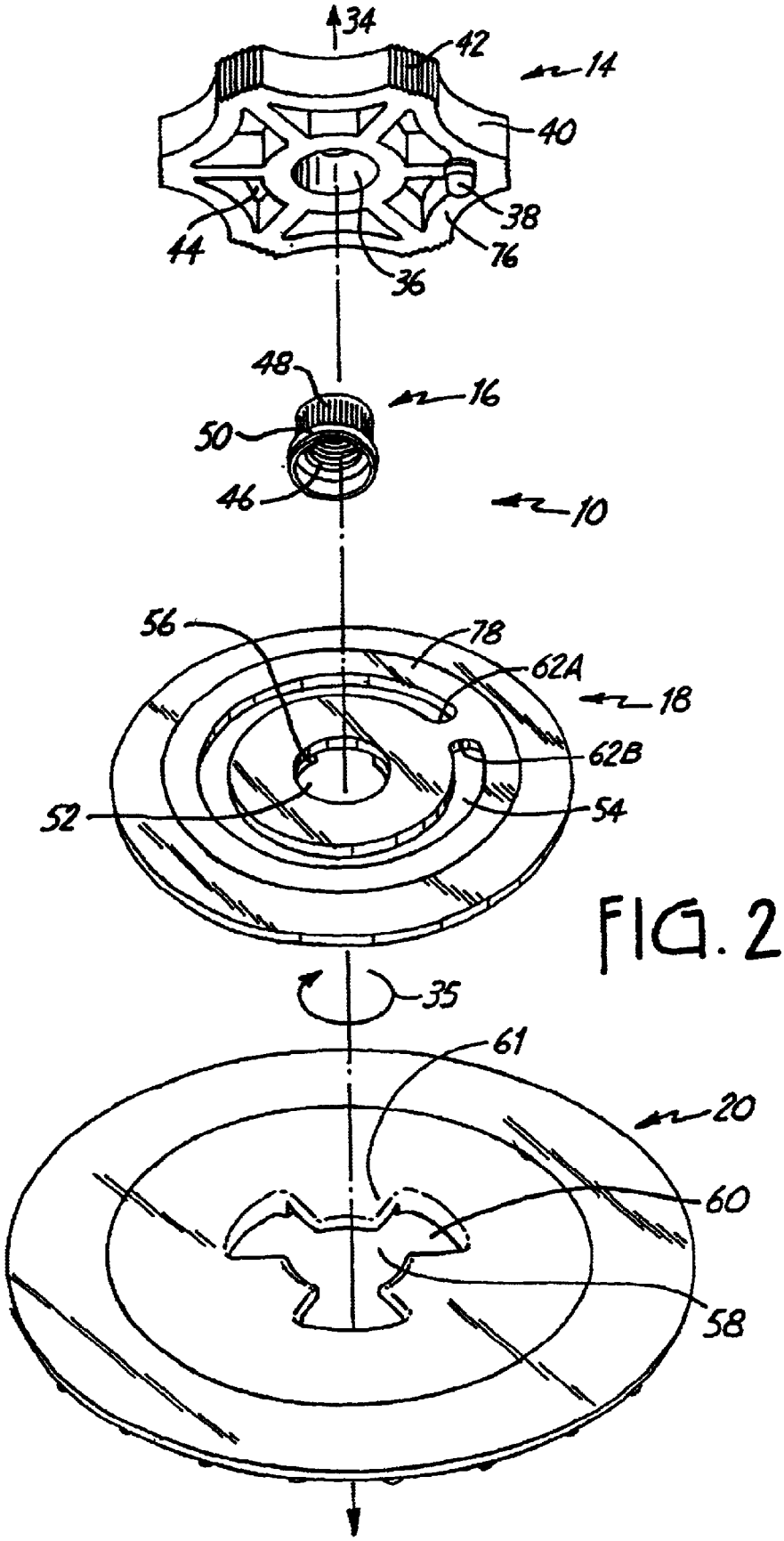
FIG. 2 is an exploded perspective view of the holder shown in FIG. 1.

FIG. 2 is an exploded perspective view of components of holder 10. FIG. 2 additionally shows longitudinal axis 34, along which handle 14, central insert 16, hub 18, and face plate 20 are aligned, and tool rotation direction 35. In this description, the direction along axis 34 toward handle 14 is the "proximal" direction, and the direction toward face plate 20 is the "distal" direction. A direction radially away from axis 34 is an "outward" direction, and a direction radially toward axis 34 is an "inward" direction. In one embodiment, handle 14 includes central bore 36, pin 38, notches 40, ribs 42, and cored regions 44. Central insert 16 includes internally threaded central bore 46, external knurls 48, and flange 50. Hub 18 includes central bore 52, channel 54, and tabs 56. Face plate 20 includes central bore 58 with a plurality of radially disposed recesses 60.

In one embodiment, handle 14 is composed of a polymeric material and comprises a generally flat cylindrical shape with two planar, roughly circular, faces joined by a generally cylindrical perimeter edge surface. Examples of suitable polymeric materials that are widely available, economical, light weight, durable, strong, impact resistant, and easy to manufacture include polyamide and glass-filled nylon. A plurality of notches 40 may be disposed about the circumferential perimeter of handle 14 to make it easier for an operator to grasp and turn handle 14 relative to the assembly of hub 18, faceplate 20, and abrasive disc 12. Notches 40 may be sized and positioned, for example, to comfortably fit the grip of a variety of users. While six notches 40 are shown, there may be more or fewer, as can be appreciated by one skilled in the art. Notches 40 may comprise, for example, smooth, concave indentations, evenly spaced around the circumference of handle 14, which allow for improved grip without sharp edges. Surface texture, such as ribs 42, may also be disposed about the perimeter of handle 14 to enhance an operator's gripping ability. Ribs 42 may be disposed on the unnotched circumferential surface of handle 14, as shown in FIG. 2, or on the concave surfaces of notches 40, or on the entire perimeter surface of handle 14.

To save on weight and materials, cored regions 44 may be used to eliminate unnecessary material. This removal of excess material may lead to improved process control during manufacture and increased dimensional stability in the finished handle 14. It also may increase the maximum operating speed of handle 14. Typically, grinders reach speeds of about 5000 to 7500 RPM. Moreover, decreasing the mass of handle 14 can reduce the weight borne by the operator, thereby reducing worker fatigue. Also, requiring less material can result in cost savings. Pin 38 is disposed on distal face 76 of handle 14 which abuts hub 18 so that pin 38 can travel in channel 54 as handle 14 is rotated relative to hub 18. In an alternative embodiment, pin 38 may be disposed on proximal face 78 of hub 18, and channel 54 may be disposed on distal face 76 of handle 14. While pin 38 is illustrated as being generally cylindrical, it may comprise other shapes and forms, as can be appreciated by one skilled in the art. Handle 14 concentrically surrounds a proximal portion of central insert 16. In one embodiment, handle 14 has a diameter of about 3.5 inches (8.9 cm) and a thickness of about 0.5 inch (1.3 cm).

Central insert 16 is a generally cylindrical, internally threaded member composed, for example, of a metal which is resistant to deformation under high torque forces. Metals such as cold rolled steel may be chosen, for example, for its widespread availability, economy, light weight, durability, and ease of manufacture. Other suitable materials include hardened steel and cast alloys. Central insert 16 includes internally threaded bore 46 for threaded attachment of central insert 16 to externally threaded rotating shaft 63 of a finishing tool, which is shown and described further in FIG. 4. Central insert 16 also includes outwardly disposed flange 50 on a distal portion of central insert 16. Central insert 16 may include external surface textures such as knurls or ribs 48 to facilitate a non-slipping press fit between central insert 16 and bore 36 of handle 14. Knurls 48 preferably comprise linear, parallel, and closely spaced ribs, oriented parallel to axis 34, and disposed on an outer cylindrical surface of a proximal portion of central insert 16. Alternatively, for example, central insert 16 may be insert molded into handle 14 so that they are permanently and fixedly attached.

In one embodiment, central insert 16 has a total length of about 0.9 inch (2.3 cm), and flange 50 comprises about the distal 0.3 inch (0.8 cm) of central insert 16. Central insert 16 has an outer diameter of about 0.9 inch (2.3 cm) at its proximal end and an outer diameter of about 1.1 inch (2.8 cm) at flange 50.

Hub 18 concentrically surrounds central insert 16 and is rotatable with respect to central insert 16. Hub 18 may be composed, for example, of a polymeric material such as polyamide, or glass-filled nylon. Hub 18 comprises bore 52, through which central insert 16 passes. Channel 54 comprises a partial annular channel disposed in a proximal face 78 of hub 18, which abuts handle 14. In one embodiment, discontinuous arcuate channel 54 is an arc of about 345 degrees (or even, for example, about 348.5 degrees), and has channel end faces 62A and 62B. Other rotational distances are also contemplated, as long as channel 54 is long enough to allow for adequate loosening of hub 18 from handle 14. Channel 54 may be slightly deeper than the height of pin 38 of handle 14 and slightly wider than the diameter of pin 38, in order to allow for free motion of pin 38 within channel 54. While FIG. 2 illustrates an embodiment with pin 38 on handle 14 and channel 54 on hub 18, it is contemplated that alternatively, a pin may be disposed on hub 18, and a corresponding channel may be disposed on handle 14.

In one embodiment, hub 18 has a diameter of about 4.5 inches (11.4 cm) and a total thickness of about 0.7 inch (1.8 cm); channel 54 extends about 0.3 inch (0.8 cm) deep into the proximal face of hub 18 and is positioned approximately 1 inch (2.5 cm) from axis 34. Of course, other dimensions may be used, depending, for example, on the size of abrasive disc 12. Hub 18 further includes radially disposed tabs 56 on a distal face 67 of hub 18 (see FIG. 3) for non-rotational attachment of hub 18 to face plate 20 via mating recesses 60.

Face plate 20 concentrically surrounds central insert 16 and may be composed, for example, of a polymeric material such as a polyamide or thermoplastic elastomer. Face plate 20 includes bore 58 through which central insert 16 passes. Bore 58 may be shaped, for example, to include recesses 60 between tabs 61, the configuration of which will be discussed further with respect to FIG. 3. Recesses 60 mate with tabs 56 of hub 18 so that when face plate 20 is pressed onto hub 18, tabs 56 fit into recesses 60, thereby forming an integral hub and face plate assembly.

In one embodiment, face plate 20 has a diameter of about 7 inches (17.8 cm) and a total thickness of about 0.25 inch (0.6 cm). Bore 58 has an outer diameter (not including tabs 61) of about 2.3 inches (5.8 cm) and an inner diameter (the circle formed by the interior radial surfaces of tabs 61) of about 1.1 inch (2.8 cm). However, face plate 20 may comprise many different sizes and materials corresponding to the size of abrasive disc 12, the workpiece characteristics, and the flexibility desired of face plate 20. For example, a detailed workpiece may require use of a relatively small abrasive disc 12 to allow for maneuverability around the contours of the workpiece. In that case, a smaller face plate 20, to match the size of abrasive disc 12, may be used. In contrast, when using a larger abrasive disc 12, a larger faceplate 20 may be desired so that it could support the entire abrasive surface of disc 12.

When holder 10 is assembled, pin 38 travels within channel 54 so that handle 14 and hub 18 have a limited rotational engagement. End faces 62A and 62B in channel 54 prevent over-spinning and possible disengagement of abrasive disc 12. In one alternative embodiment, channel 54 may be a complete annular channel with a fixed obstruction therein to form channel end faces 62A and 62B and to prevent pin 38 from traveling more than one rotation.

In use, handle 14 rotates with the shaft of the finishing tool in direction 35. At the beginning of the shaft rotation in direction 35, pin 38 travels in channel 54 in the direction of rotation. When pin 38 reaches end face 62A of channel 54, pin 38 engages hub 18 so that hub 18 begins to rotate with handle 14 and the rotating tool shaft. Face plate 20 is attached to hub 18 and rotates along with hub 18.

Figure 3:
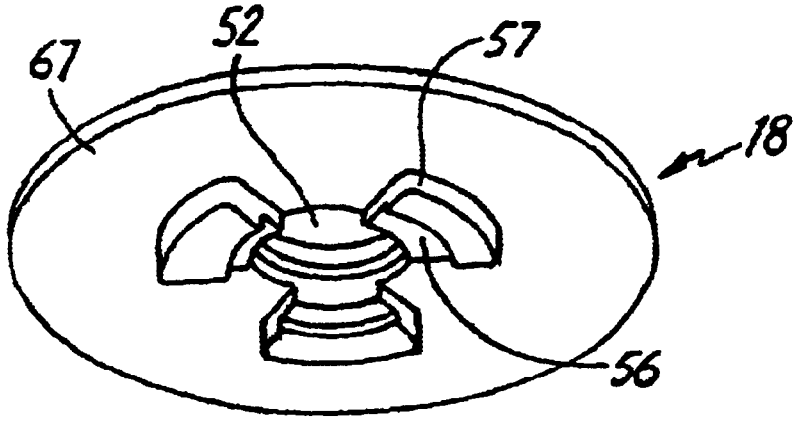
FIG. 3 is a perspective view of a hub and face plate according to the present invention.
Figure 3:
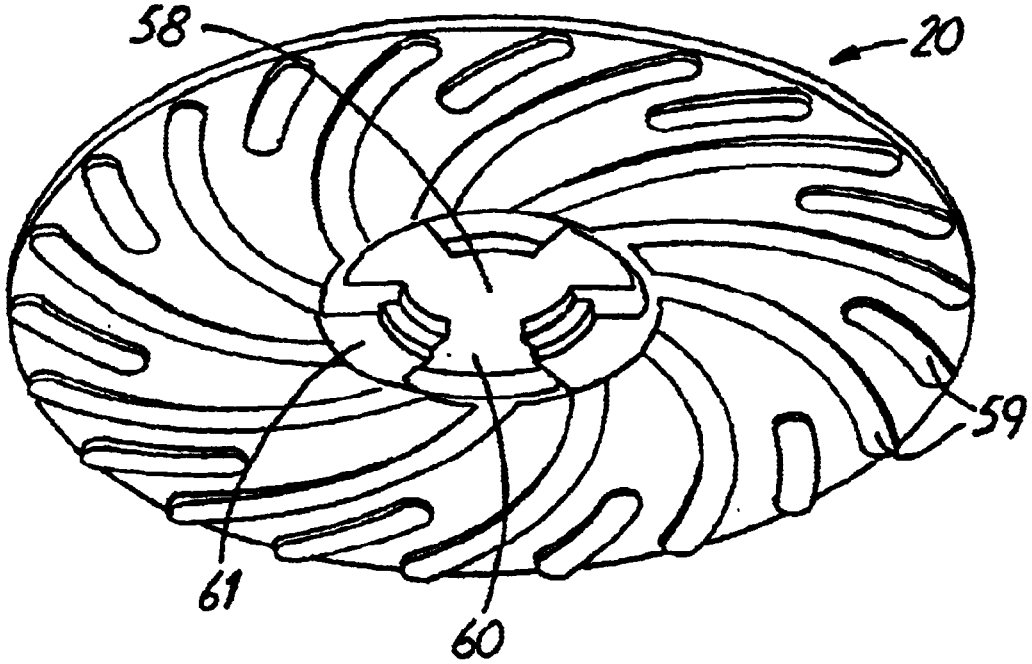

FIG. 3 illustrates the distal surfaces of hub 18 and face plate 20, showing the spacial interrelation between tabs 56 on hub 18 and recesses 60 between tabs 61 in faceplate 20. When assembled, each tab 56 fits into a corresponding recess 60 between tabs 61 so that hub 18 and face plate 20 form an integral unit which rotates together. While FIG. 3 shows three trapezoidal tabs 56 on hub 18 and three trapezoidal tabs 61 with corresponding recesses 60 on face plate 20, it would be clear to one skilled in the art that any number and shape of interlocking tabs and recesses could be used to provide for a nonrotational attachment of face plate 20 to hub 18.

Figure 4:
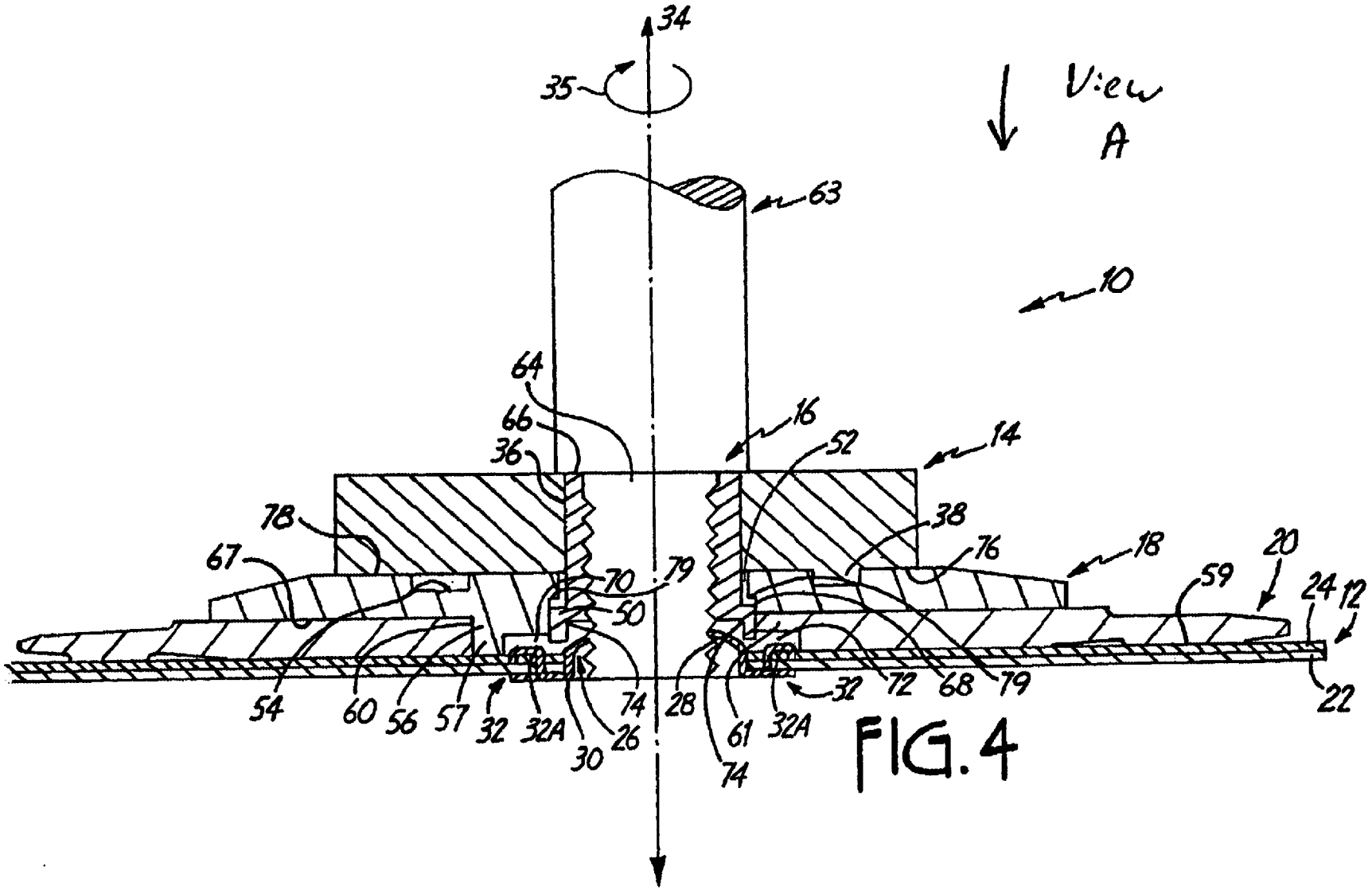
FIG. 4 is a sectional elevation view of the holder and abrasive disc shown in FIG. 1, mounted on a tool shaft.

In one embodiment, hub 18 includes three tabs 56 disposed on the distal face of hub 18, equally spaced about, and adjacent to, bore 52. Each tab 56 is a distal projection from face 67 of hub 18 and comprises a curved trapezoidal member, with a wider side disposed radially away from bore 52. The outer edge of each tab 56 comprises a flange 57 which extends distally from the distal face of hub 18. As can be seen in FIG. 4, flange 57 forms recess 70 that allows for clearance space for tips 32A of tines 32 of central nut 26 on abrasive disc 12.

In one embodiment, three tabs 61, of substantially the same configuration as tabs 56, are disposed on face plate 20, equally spaced about, and extending within, bore 58. Tabs 56 are shaped and sized to press into recesses 60 between tabs 61 to form an integral recessed circular surface in the hub and face plate unit.

Faceplate 20 is interchangeable and allows the operator to select various degrees of flexibility by using different materials or constructions. In one embodiment, for example, ribs 59 reduces the surface area of faceplate 20 in contact with abrasive disc 12. Compared to a planar faceplate, the operator can therefore transfer the same grinding pressure to the workpiece with less effort on the power tool. This results in less fatigue for the operator when using ribbed faceplate 20. As shown in FIG. 3, ribs 59 are comprised of curved arms of various lengths emanating radially from center bore 58. However, one skilled in the art will realize that a variety of rib configurations may be used.

FIG. 4 is a sectional, elevation view of holder 10 attached to abrasive disc 12 and mounted on tool shaft 63. Shaft 63 includes threaded portion 64 and shoulder 66. FIG. 4 additionally shows recess 68 in hub 18, recess 70 in hub 18, recess 72 in face plate 20, and recess 74 in central insert 16.

Holder 10 is initially assembled by inserting central insert 16 into bore 52 of hub 18. Flange 50 of central insert 16 engages shoulder 79 of hub 18, formed at recess 68. A proximal portion of central insert 16 is then inserted into bore 36 of handle 14 so that pin 38 of handle 14 is engaged in channel 54 of hub 18. The assembly is then threaded onto threaded portion 64 of rotating shaft 63. Flange 50 engages recess 68 in hub 18 to hold handle 14 and hub 18 against shoulder 66 of shaft 63. While shoulder 66 is illustrated, a person skilled in the art would realize that any stop mechanism may be utilized, such as a nut or washer. Holder 10 is completed by pressing face plate 20 onto hub 18 so that tabs 56 of hub 18 press into recesses 60 of face plate 20. This engagement produces a hub and face plate assembly which moves (i.e., rotates) together as a unit. Face plate 20 can be changed simply by pressing face plate 20 off and onto hub 18, without disassembly of the rest of holder 10.

Abrasive disc 12 is then mounted on shaft 63 by threading central nut 26 onto the end of threaded portion 64 so that the plate of backing material 24 of abrasive disc 12 abuts the distal face of face plate 20. Recess 70 in hub 18, recess 72 in face plate 20, and recess 74 in central insert 16 are provided to allow for a clearance space about central nut 26. The adjacent arrangement of abrasive disc 12 and face plate 20 prevents over-tightening of nut 26, thereby preventing distortion of nut 26.

To remove abrasive disc 12 from holder 10, an operator grasps handle 14 with one hand and the assembly of hub 18, faceplate 20, and abrasive disc 12 with the other hand. The operator rotates the assembly of hub 18, faceplate 20, and abrasive disc 12 relative to handle 14 in the direction of shaft rotation direction 35 relative to view A. During this counterrotation, pin 38 travels in channel 54 until pin 38 meets channel end face 62B. This action causes abrasive disc 12 to be unthreaded from threaded portion 64 of shaft 63 by nearly one rotation, thereby breaking the tight lock of abrasive disc 12 on shaft 63. Once this lock is broken, an operator may easily continue to unthread abrasive disc 12 from shaft 63, ultimately removing worn disc 12 and replacing it with another abrasive disc 12.

Although the present invention has been described with reference to preferred embodiments, workers skilled in the art will recognize that changes may be made in form and detail without departing from the spirit and scope of the invention.

What is claimed is:

1. A holder for supporting an abrasive disc on a tool shaft, the holder comprising:

an annular internally threaded central insert threadably engaging the shaft;

a handle concentrically surrounding and in fixed rotational engagement with the central insert;

a hub concentrically surrounding the central insert, abutting the handle, and rotationally engaged to the handle;

a pin disposed on a first face of at least one of the handle or hub;

a discontinuous channel disposed on a second face of the handle or hub, the channel opposing the pin, so that the pin engages the channel and travels within the channel as the handle and hub are rotated with respect to each other; and a faceplate concentrically surrounding the central insert, abutting the hub, and removably engaged to the hub.

2. The holder of claim 1 wherein:

the first face is disposed on the handle; and the second face is disposed on the hub.

3. The holder of claim 2 wherein the abrasive disc has a centrally located nut, and the central insert is spaced from the nut.

4. The holder of claim 2 wherein the central insert is made of metal and the handle, hub, and faceplate are made of polymeric materials.

5. The holder of claim 2 wherein the faceplate comprises a rib design on a surface of the faceplate adjacent to the abrasive disc.

6. The holder of claim 2 wherein the channel is arcuate with an arc of about 345 degrees.

7. The holder of claim 2 wherein the abrasive disc includes a backing plate comprised of glass-filled nylon material.

8. The holder of claim 2 wherein the handle comprises a generally cylindrical shape.

9. The holder of claim 8 wherein the handle comprises a plurality of notches about the perimeter of a generally cylindrical surface.

10. The holder of claim 2, further comprising:

a flange disposed on an outer surface of the central insert; and a recess disposed on an inner surface of the hub, wherein the flange of the central insert engages the recess of the hub to retain the hub against the handle.

11. The holder of claim 10 wherein the abrasive disc has a centrally located nut, and the central insert is spaced from the nut.

12. The holder of claim 10, further comprising:

a recess disposed in the faceplate; and a tab disposed in the hub, wherein the tab of the hub engages the recess of the faceplate to form an integral faceplate and hub assembly.

13. The holder of claim 2, further comprising:

a recess disposed in the faceplate; and a tab disposed in the hub, wherein the tab of the hub engages the recess of the faceplate to form an integral faceplate and hub assembly.

14. The holder of claim 13 wherein the faceplate and hub assembly comprises a recess such that the assembly is spaced from a nut of the abrasive disc.

15. The holder of claim 13, further comprising:

a flange disposed on an outer surface of the central insert; and a recess disposed on an inner surface of the hub, wherein the flange of the central insert engages the recess of the hub to retain the hub against the handle.

16. The holder of claim 13 wherein the abrasive disc has a centrally located nut, and the central insert is spaced from the nut.

17. The holder of claim 13 wherein the handle comprises a generally cylindrical shape.

18. The holder of claim 13 wherein the channel is arcuate with an arc of about 345 degrees.

19. The holder of claim 1 wherein:

the first face is disposed on the hub; and the second face is disposed on the handle.

20. A holder for supporting an abrasive disc on a tool shaft, the abrasive disc having a centrally located nut, the holder comprising:

an annular internally threaded central insert threadably engaging the shaft and spaced from the nut of the abrasive disc;

a handle concentrically surrounding and in fixed rotational engagement with the central insert;

a hub concentrically surrounding the central insert, abutting the handle, and rotationally engaged to the handle; the hub including a tab;

a pin disposed on a face of the handle or the hub;

a discontinuous channel disposed on a face of the handle or the hub, the channel opposing the pin, so that the pin engages the channel and travels within the channel as the handle and hub are rotated with respect to each other;

a flange disposed on an outer surface of the central insert;

a recess disposed on an inner surface of the hub, wherein the flange of the central insert engages the recess of the hub to retain the hub against the handle; and a faceplate concentrically surrounding the central insert, abutting the hub, and removably engaged to the hub, the faceplate having a recess, wherein the tab of the hub engages the recess of the faceplate to form an integral faceplate and hub assembly.

* * * * *